United States Patent [19]

Baillot et al.

[11] 4,119,505

[45] Oct. 10, 1978

[54] PROCESS AND DEVICE FOR CLEANING THE BUTTS OF WORN ANODES FROM AN IGNEOUS ELECTROLYSIS CELL

[75] Inventors: Pierre Baillot; Pierre Berthet, both of Albertville, France

[73] Assignee: Aluminium Pechiney, Lyons, France

[21] Appl. No.: 784,963

[22] Filed: Apr. 6, 1977

[30] Foreign Application Priority Data

May 4, 1976 [FR] France ..... 76 13998

[51] Int. Cl.[2] ..... C25C 3/00; C25C 3/06

[52] U.S. Cl. ..... 204/67; 204/243 R; 204/245

[58] Field of Search ..... 204/243 R, 245, 67

[56] References Cited

U.S. PATENT DOCUMENTS

| | | | |
|---|---|---|---|
| 3,663,411 | 5/1972 | Springer | 204/243 R |
| 3,769,195 | 10/1973 | Weterings | 204/245 |

*Primary Examiner*—Howard S. Williams

*Attorney, Agent, or Firm*—McDougall, Hersh & Scott

[57] ABSTRACT

The invention relates to a process and apparatus for ridding the worn anode butts of electrolysis bath crusts which adhere to them.

The apparatus essentially comprises a jack supporting a pneumatic drill equipped with a percussion tool. The jack is supported by a movable and orientatable arm.

Application to the recovery of worn anodes from igneous electrolysis cells for the manufacture of aluminium.

5 Claims, 5 Drawing Figures

PROCESS AND DEVICE FOR CLEANING THE BUTTS OF WORN ANODES FROM AN IGNEOUS ELECTROLYSIS CELL

The invention relates to a process and a device for cleaning worn anode butts from igneous electrolysis cells.

In cells used for the manufacture of aluminium by igneous electrolysis, the oxygen formed by the decomposition of the alumina burns the internal surface of the carbon anode. It is therefore necessary to renew the anode material at more or less regular intervals.

In cells which are equipped with ready baked anodes, the anode is made of several juxtaposed carbon elements which are replaced one after the other, based on their degree of wear.

The part of the worn anode which adheres to the suspending device is usually called a "butt".

When replacing the elements, the solidified electrolyte crust which covers these carbon "butts" has to be removed in order separately to recover the electrolyte and the carbon so that they may be recycled.

This cleaning may take place either in a specialized work shop in which the butts to be cleaned are assembled, or on the cell itself, which eliminates handling and loss of the product. Furthermore, in the latter case, the crusts of electrolyte are detached more readily than after total cooling.

Whatever the case, this operation, which is usually carried out with the aid of primitive equipment, demands great effort from the operator in an atmosphere which is made particularly arduous by the dust and the heat.

The present invention relates to a process and a machine for cleaning the "butts" which may either be adapted to the working apparatus used in the electrolysis rooms, such as overhead travelling-cranes, velocipede cranes and gantries, or mounted on an independent self-propelled appliance, or installed in a fixed position in a specialized work shop.

According to the invention, this cleaning machine is essentially comprised of a pneumatic pick of a known model, equipped with a percussion tool, borne by an articulated arm operated for movement by remote control from the service cabin of the appliance upon which it is mounted.

In this way, the operator is protected from the heat and the dust and may direct the pneumatic pick in such a way that he is situated in the best possible position for attacking the crust of electrolyte covering the butt of the anode which has just been withdrawn from the cell.

The invention described above is illustrated in the attached drawings, in which the cleaning device is suspended from an overhead travelling-crane.

In these figures, the same elements are given the same reference numbers.

Figure 1:
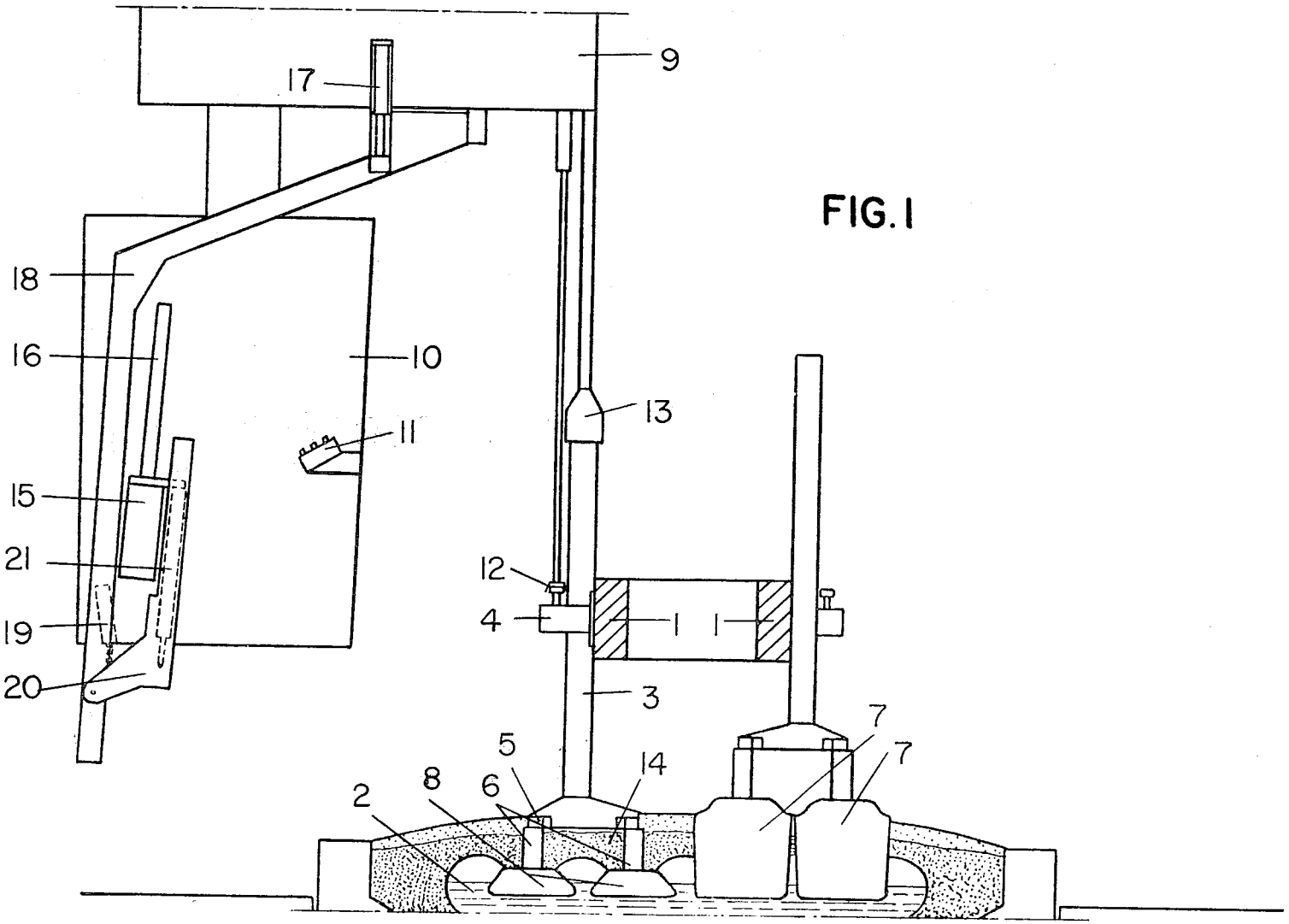
FIG. 1 is an elevational view of the machine in the rest position in the immediate vicinity of an electrolysis cell, one worn anode element of which is about to be extracted.

In the cell shown in the drawings, the electric current, which is provided by anode bars 1, is conveyed successively through the aluminium rod 3, which is kept in contact with the bar 1 by means of the clamp 4, the steel block 5, the steel rods 6 and finally the carbon blocks 7 and 8, towards the liquid electrolyte 2.

The electric current causes the oxygen from the alumina, which is dissolved in the electrolyte 2, to be liberated and to burn the internal surface of the anode blocks so that the block 7 of the new anode element is gradually reduced to the size of the block 8 of the worn anode element.

At this stage of wear, this element must be replaced by a new element. For this purpose, an apparatus provided beneath the trolley 9 of the working overhead travelling-crane (not shown in the figures) is used. The operator, who sits in the cabin 10 and acts by means of the control desk 11, releases the clamp 4 with the aid of the hydraulic key 12, extracts the worn element 8 with the aid of the pneumatic key 13 and places it in the position shown in FIGS. 3 and 4, resting against the steel rods 6 of an adjacent anode element.

The worn anode element is then in a good position for the removal of the covering solidified electrolyte crust 14 by means of the machine which forms the subject of the invention, and the operator, acting from the cabin 10 and the desk 11, can start the cycle of operations hereinafter described.

Figure 2:
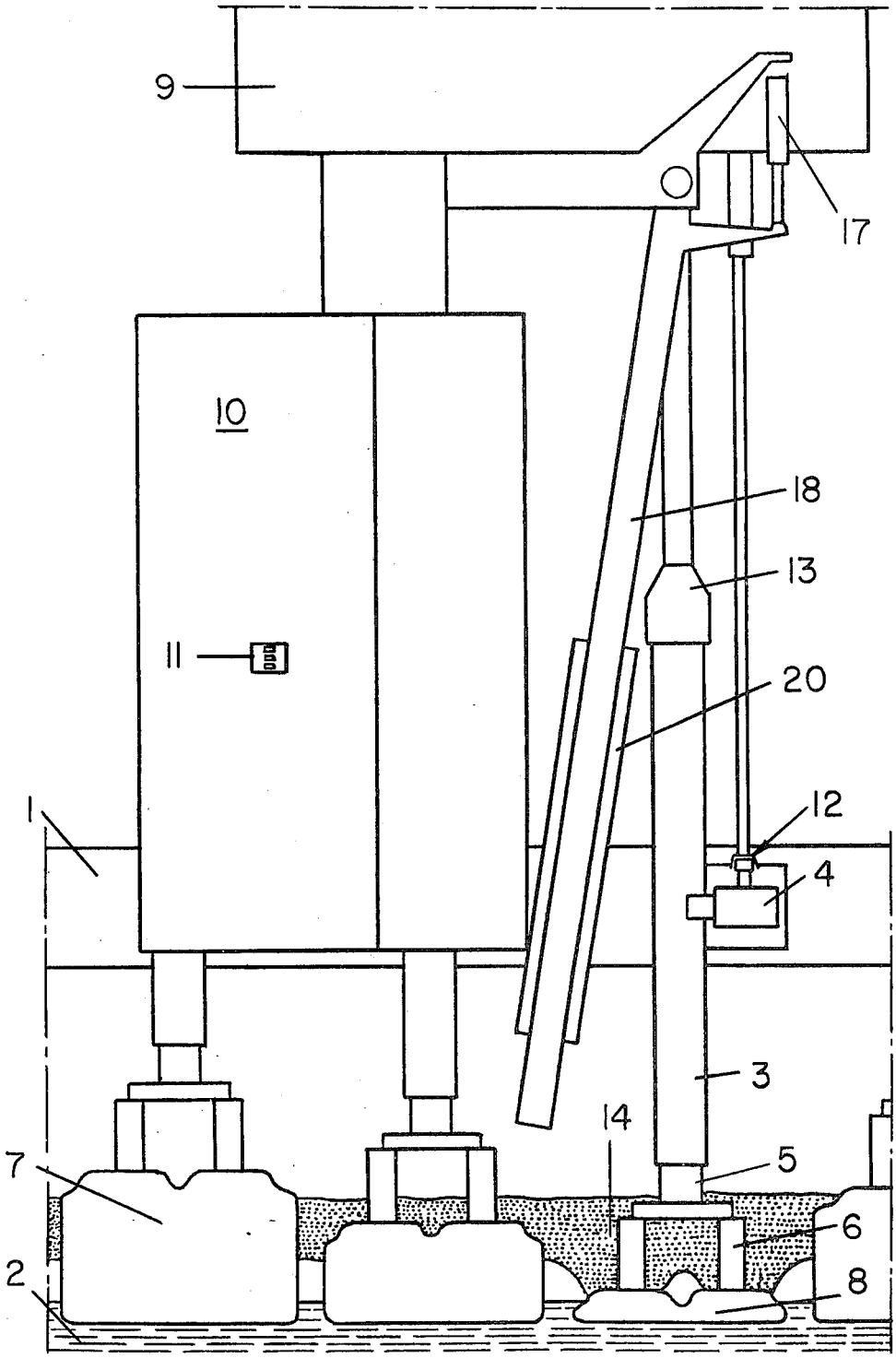
FIG. 2 is an elevational view of the machine shown in FIG. 1 in an orthogonal plane.
Figure 3:
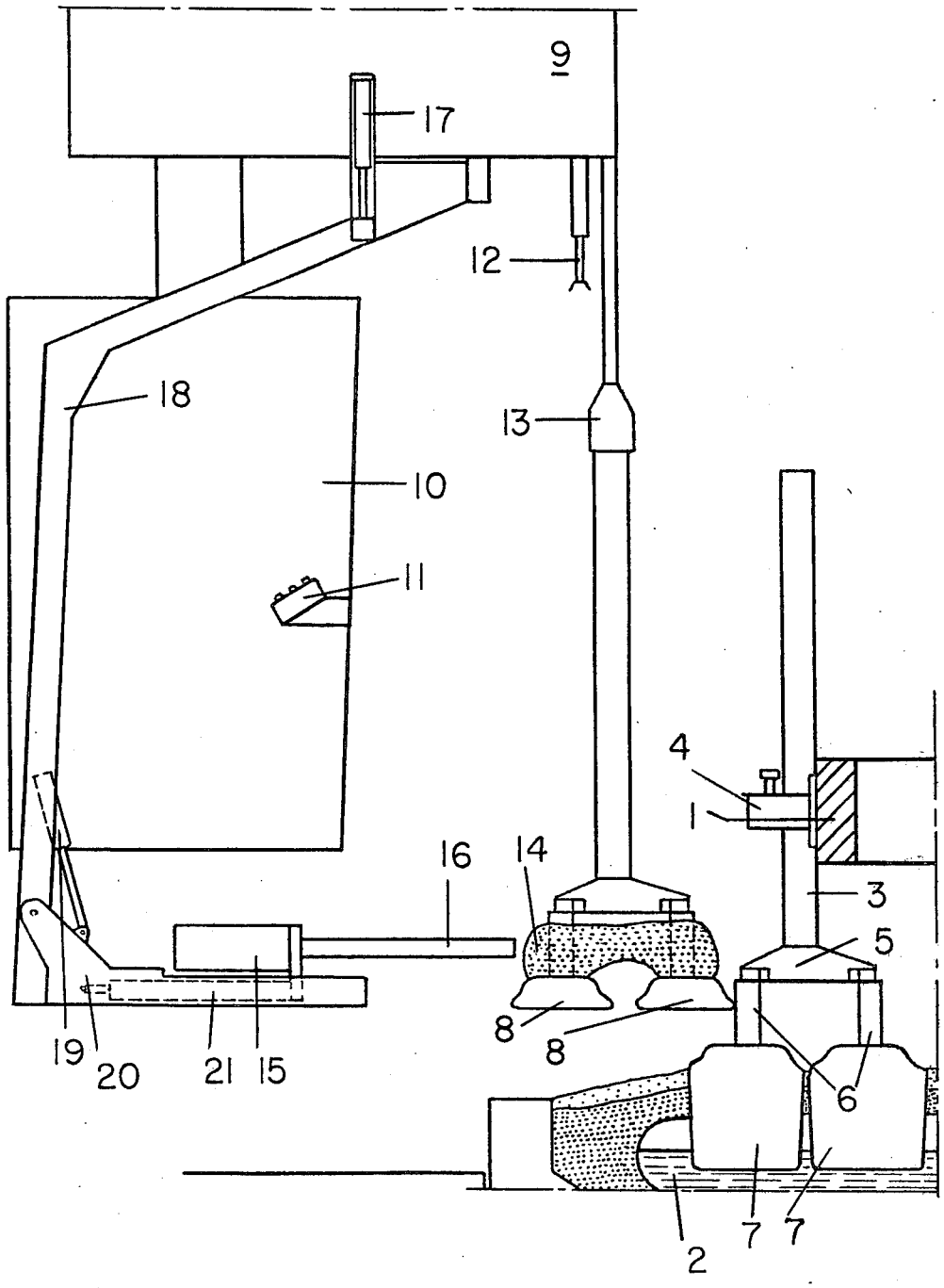
FIG. 3 is an elevational view of the machine as it is about to act upon a worn anode element which has previously been withdrawn from the cell.
Figure 4:
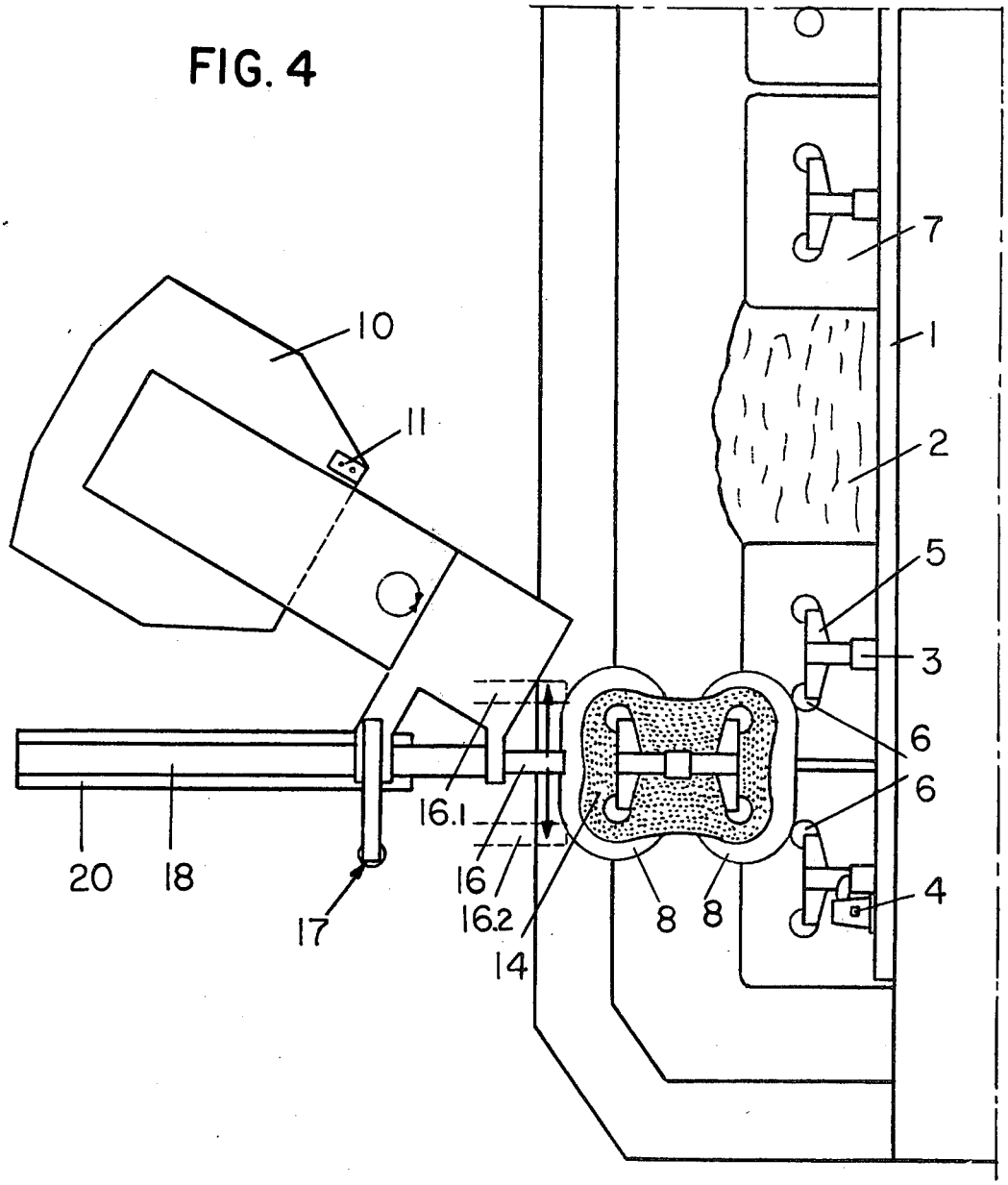
FIG. 4 is a plan of the machine in the position shown in FIG. 3.

In a first stage, the pneumatic pick 15, which is provided with the tool 16, is conveyed from its rest position as shown in FIGS. 1 and 2 to its operating position as shown in FIGS. 3 and 4 by the action of two hydraulic jacks; the jack 17 conveys the assembly of the apparatus into the vertical lane by means of the arm 18, and the jack 19 lowers the cradle 20 until the pneumatic pick and its tool are in the horizontal position.

Figure 5:
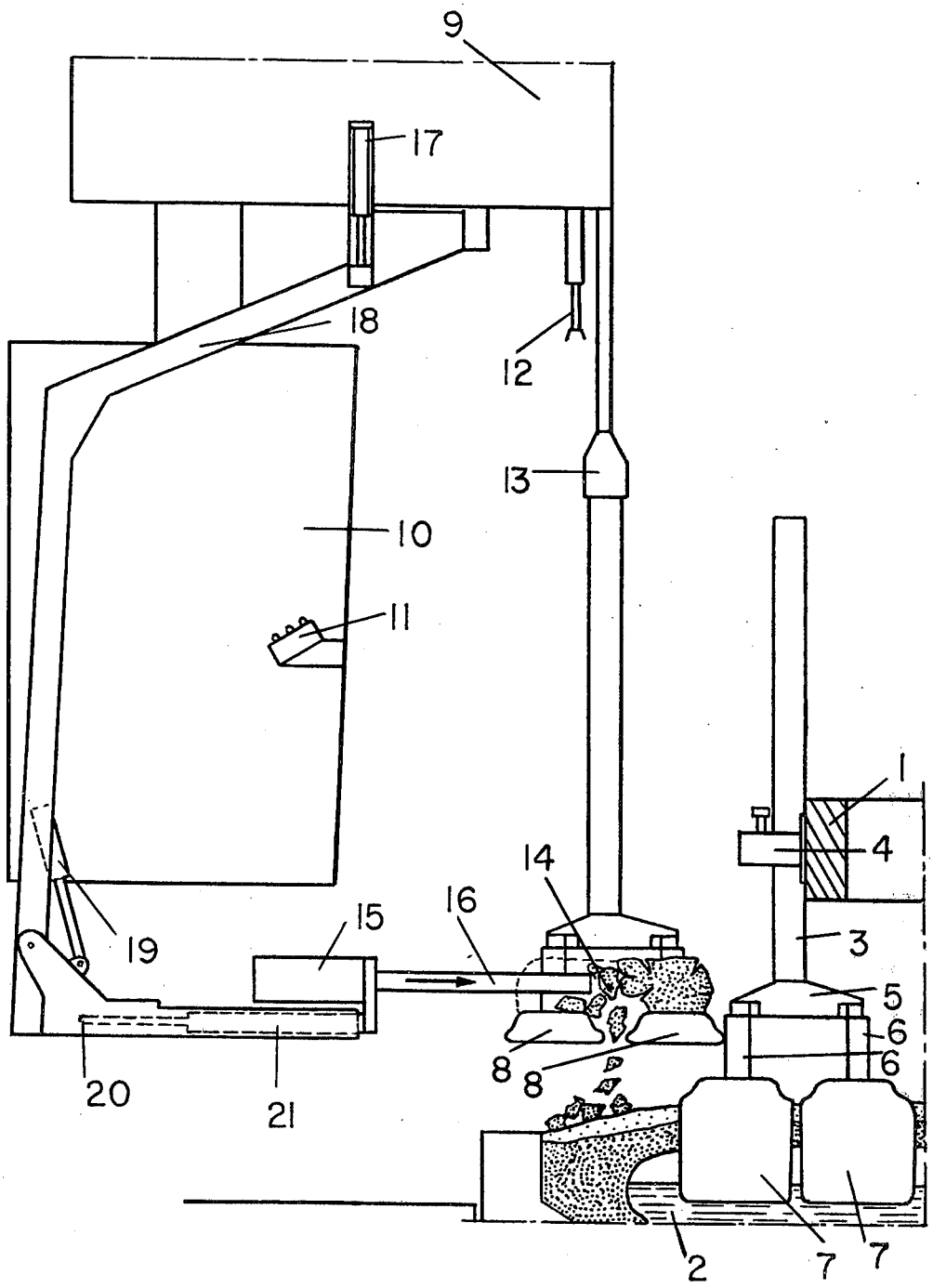
FIG. 5 is an elevational view of the machine in the process of dislodging by piercing the solidified electrolyte crust covering the butt.

In a second stage, the operator feeds compressed air simultaneously to the pneumatic pick, thus activating its hammering action, and to the pneumatic jack 21, thus causing the pneumatic pick to advance firstly until the tool 16 comes into contact with the solidified electrolyte crust 14 and then, under the effect of hammering, until the tool has passed right through this crust after having broken it into pieces, as shown in FIG. 5.

In a third stage, if the crust 14 has not been completely broken, the operator may recommence the operation described above using the opportunity afforded by the jack 17, of making the assembly of the apparatus work in other planes apart from the vertical plane and thereby to attack the crust 14 in all the positions of the tool 16 comprised between the positions 16-1 and 16-2, shown in FIG. 4.

In a variation on the implementation of the process, the starting up of the precussion system of the pneumatic pick is subject to a certain predetermined level of resistance encountered by the tool 16, in the known manner. In this way, the energy required for percussion may be saved if the crust 14 is not very hard and splinters under the mere effect of the thrust exerted by the jack 21.

Different types of pneumatic picks may be used for implementing the invention. However, it has been noted that the highest efficiency was obtained with heavy types of hammer, such as those used on the public works sites.

On account of the adherence of the electrolytic crusts on the anode butts, it is also preferable that the thrust exercised by the jack 21 be at least 300 daN.

The process and the device which form the subject of the invention are particularly suitable for cleaning butts of anodes extracted from igneous electrolysis cells with a view to recovering the electrolyte crusts which remain adherent, which is particularly the case in the manufacture of aluminium by igneous electrolysis. This process and device allows the operator to be protected from the dust, the noxious gases, the heat and the noise, enables almost all of the electrolyte to be recovered and facilitates the re-installation of new anode elements on the suspending rods which has been cleaned in this way.

The device which forms the subject of the invention may be mounted on any type of electrolysis cell service appliance, such as overhead travelling-cranes, velocipede cranes, semi-gantries, self-propelling appliances, and trolleys. It may also be used in a fixed position for cleaning worn anodes at a site situated some distance from the electrolysis cells.

We claim:

1. Process for ridding the worn anode elements of igneous electrolysis cells of covering solidified electrolyte crust in replacement of the anode comprising the steps of raising the worn anode vertically from the cell to a level above the surface of the cell, backing the raised anode from one side, aligning a percussion tool with the crust on the other side of the raised anode, moving the percussion tool towards contact with the crust of the raised anode, actuating the percussion tool rapidly to impact the crust to break the crust for release from the worn anode, and controlling such movement from a remote station.

2. Process as claimed in claim 1, in which the start up of the percussion is subject to a minimum predetermined value of the resistance with which the said crusts oppose the thrusting device.

3. Device for implementing the process of claim 1 comprising means for lowering and raising anodes into and out of the electrolysis cell respectively, a percussion tool, a jack means supporting the percussion tool for movement into alignment with the worn anode while in raised position above the cell, means for movement of the raised anode into contact with an adjacent support for backing the raised anode, and means for actuating the percussion tool into engagement for impacting the crust on the raised anode for removal of the crust.

4. Device as claimed in claim 3, which includes a movable arm which supports the jack, and means whereby the movable arm may be orientated and folded into a rest position.

5. The process as claimed in claim 1 which includes the step of adjusting the position of the percussion tool to position the tool for engagement with the crust from various angles and/or from different levels.

* * * * *